US007976329B2

(12) United States Patent
Foung

(10) Patent No.: US 7,976,329 B2
(45) Date of Patent: Jul. 12, 2011

(54) CONNECTOR LOCKING DEVICE

(75) Inventor: Paul Foung, North Brunswick, NJ (US)

(73) Assignee: Archtech Electronics Corporation, Dayton, NJ (US)

( * ) Notice: Subject to any disclaimer, the term of this patent is extended or adjusted under 35 U.S.C. 154(b) by 0 days.

(21) Appl. No.: 13/022,400

(22) Filed: Feb. 7, 2011

(65) Prior Publication Data

US 2011/0124217 A1 May 26, 2011

Related U.S. Application Data

(62) Division of application No. 12/546,270, filed on Aug. 24, 2009, now Pat. No. 7,892,012.

(51) Int. Cl.
*H01R 13/627* (2006.01)

(52) U.S. Cl. ..... 439/352; 439/344

(58) Field of Classification Search ..... 439/304, 439/305, 310, 344, 347, 352–355, 357, 358, 439/488, 489

See application file for complete search history.

(56) References Cited

U.S. PATENT DOCUMENTS

| | | | | |
|---|---|---|---|---|
| 5,507,666 | A * | 4/1996 | Yamanashi | 439/489 |
| 5,910,027 | A * | 6/1999 | Wayt et al. | 439/489 |
| 6,261,116 | B1 * | 7/2001 | Ceru | 439/352 |
| 6,435,895 | B1 * | 8/2002 | Fink et al. | 439/352 |
| 7,326,074 | B1 * | 2/2008 | Lim et al. | 439/352 |

* cited by examiner

*Primary Examiner* — Thanh-Tam T Le
(74) *Attorney, Agent, or Firm* — Fallon & Fallon LLC; Jonathan A. Fallon, Esq.

(57) ABSTRACT

Embodiments of the present invention relate to a connector locking device for network cables and methods of utilizing the same. In one embodiment of the present invention, a keyed-release connector locking device comprises a locking tongue support for supporting a locking tongue of a connector, the locking tongue of the connector consisting of a member biased about a front of the connector on a top surface thereof, extending towards a rear of the connector; a first retaining mechanism for engaging a portion of a body of a terminal, the body of the terminal comprising a structure having a housing on a top surface thereof for receiving the first retaining mechanism; and a key-accessible release arm for releasing the retaining mechanism from the portion of the body of the terminal when pivotably engaged.

17 Claims, 14 Drawing Sheets

400

CONNECTOR LOCKING DEVICE

CROSS-REFERENCE TO RELATED APPLICATIONS

This application is a divisional application of U.S. patent application Ser. No. 12/546,270, entitled "Connector Locking Device," and filed Aug. 24, 2009, the disclosure of which is incorporated herewith in its entirety.

BACKGROUND OF THE INVENTION

1. Field of the Invention

Embodiments of the present invention generally relate to a locking device for connectors. More specifically, embodiments of the present invention relate to a connector locking device for network cables and methods of utilizing the same.

2. Description of the Related Art

Connectors are used in most electrical and/or communication networks, including basic analog telephone systems, Ethernet/Internet networks, fiber optic networks, security systems, and so on. Although there are numerous types of connectors, some of the more common connectors are provided with a "Registered Jack" or "RJ" designation, which were originally created by the Federal Communications Commission (FCC). One of the first connectors is described in U.S. Pat. No. 3,860,316, issued Jan. 14, 1975 to Hardesty, entitled "Electrical Connecting Devices for Terminating Cords and Methods of Assembling the Devices to Cords," the disclosure of which is incorporated by reference in its entirety.

Most of the RJ connectors, or similar MT-RJ connectors and LC connectors for fiber optic cabling, are defined by their respective number of contact positions and conductors. For example, one of the most common network cable connectors is the RJ45, which is characterized by its 8P8C structure—that is, the RJ45 has an 8 position and 8 conductor structure. Each connector has a corresponding female connector, which is generally, affixed within an electronic or telecommunications device, for example, a computer, telephone, network router or the like.

One common aspect among nearly all connectors, particularly RJ connectors and LC connectors, is a locking tongue on the male connector. When engaged with a female connector, the locking tongue holds the connector in place, and allows data, power or the like, to be transferred through the contacts of the connectors. In most instances, the locking tongue is a simple plastic protrusion from a surface of the connector, capable of engaging a receptive portion of the female connector.

Most connectors are designed such that anybody may remove the connector from the female connector by an intentional or unintentional action of engaging the locking tongue, which in turn severs any data transfer occurring through the associated devices. While this may be an acceptable nuisance in many instances, there are also many instances where this type of abrupt data transfer interruption can have undesirable, or even devastating, consequences. As such, there is a need for a security locking device for use with standard connectors.

Various solutions at a suitable locking device for connectors have been attempted. For example, one solution discloses a built-in locking pin in the female connector for securely engaging a male connector when connected, and a key is used to turn the locking pin. However, whereas nearly all female connectors are already firmly mounted in finished electronic or communication devices, such a solution would require the removal and replacement of the female connectors in each of those devices. This type of solution may be very costly, and may require third-party assistance in ensuring the secure female connectors are properly mounted within the device.

Other exemplary attempts at providing a suitable locking device for connectors require the use of a modified connector, having one or more locking pins or screws therein. Again, because these solutions require the replacement of the connector with one of the modified types, this type of solution may be very costly. Furthermore, where locking pins or screws are used, the need for a screwdriver or similar device may be quite burdensome when cables must be desirably removed, particularly in a network router environment, where there may be hundreds of cables to be removed.

Yet further attempted solutions require bulky casing or housing devices to surround standard connectors, and prevent unintentional or unauthorized removal of the respective cables. Problems with these devices are ubiquitous in larger network environments, where a single device, like a network card, may have very tight tolerances for the numerous cables to be connected. Using a bulky casing device prevents cables to be aligned adjacent to one another in the network cards.

Thus, there is a need for an improved connector locking device and methods of utilizing the same.

SUMMARY OF THE INVENTION

Embodiments of the present invention relate to a connector locking device for network cables and methods of utilizing the same. In one embodiment of the present invention, a self-releasing connector locking device comprises a locking tongue support for supporting a locking tongue of a connector, a first retaining mechanism for engaging a portion of a body of a terminal, and a first release arm for releasing the retaining mechanism from the portion of the body of the terminal.

In another embodiment of the present invention, a keyed-release connector locking device comprises a locking tongue support for supporting a locking tongue of a connector, a first retaining mechanism for engaging a portion of a body of a terminal, and a key-accessible release arm for releasing the retaining mechanism from the portion of the body of the terminal.

In yet another embodiment, a locking cable connector assembly comprises a cable for transmitting data from a first device to a second device, a terminal on a first end of the cable having a lock support thereon, the terminal for engaging a connector having a locking tongue, and a locking device comprising a locking tongue support for supporting the locking tongue of the connector, a first retaining mechanism for engaging the lock support, and a release arm for releasing the retaining mechanism from the lock support.

BRIEF DESCRIPTION OF THE DRAWINGS

So the manner in which the above recited features of the present invention can be understood in detail, a more particular description of embodiments of the present invention, briefly summarized above, may be had by reference to embodiments, which are illustrated in the appended drawings. It is to be noted, however, the appended drawings illustrate only typical embodiments of embodiments encompassed within the scope of the present invention, and, therefore, are not to be considered limiting, for the present invention may admit to other equally effective embodiments, wherein.

Figure 1:
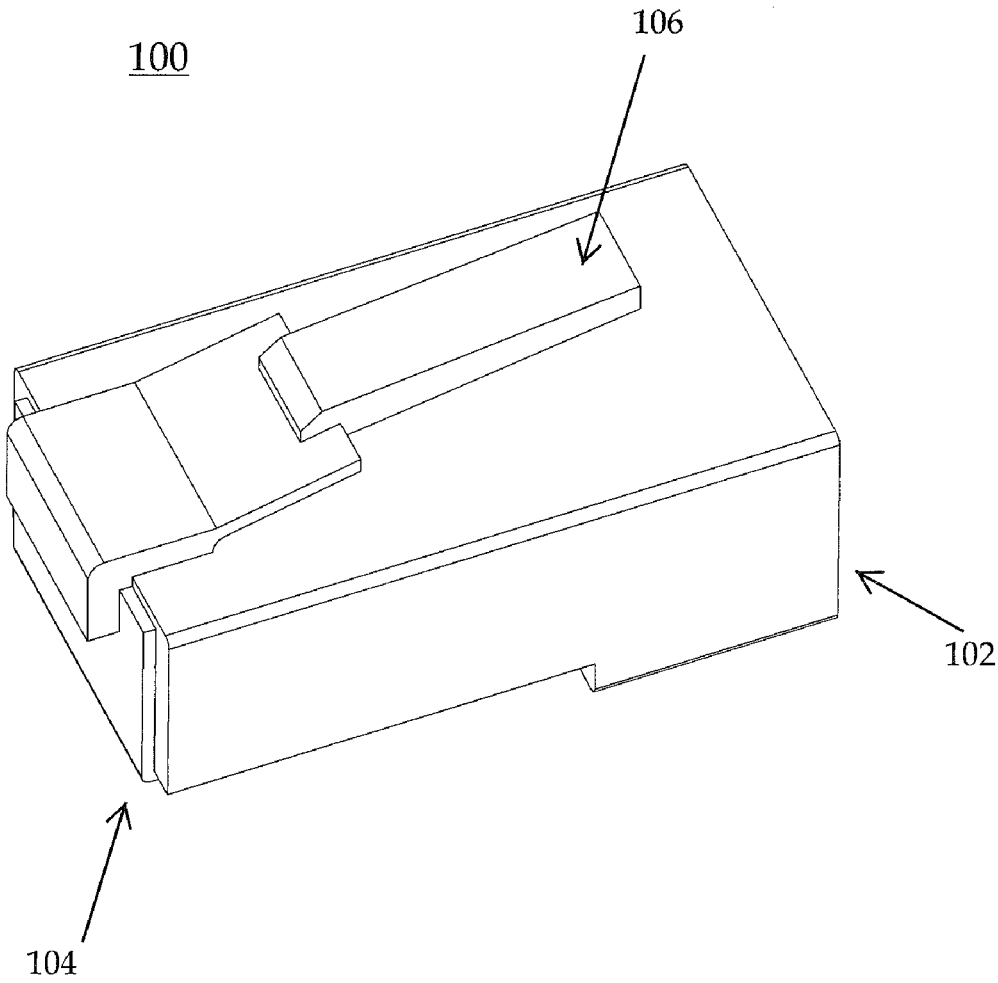
FIG. 1 depicts a perspective view of a connector in accordance with one embodiment of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present invention broadly relate to a connector locking device for network cables and methods of utilizing the same. FIG. 1 depicts a perspective view of a connector in accordance with one embodiment of the present invention. In accordance with embodiments of the present invention, a connector 100 generally comprises a terminal interface 102, a conductor portion 104, and a locking tongue 106.

The connector 100 may comprise any type of suitable connector for embodiments of the present invention. In many embodiments, the connector 100 is a modular connector, for example, a typical Registered Jack ("RJ") connector as used in the telecommunications and data networking industries. For example, in one embodiment, the connector 100 comprises 8 positions and 8 contacts (8P8C), and is commercially referred to as an RJ45 connector. In another embodiment, the connector 100 is a 6 position connector having 6 contacts (6P6C), and is commercially referred to as an RJ11 connector. Alternative connectors include any known connector in the telecommunications and data networking industries, including those which are used to transfer analog and digital signals across cables (not shown), including fiber optic cables. In one embodiment, a connector may comprise an LC connector, for example, an LC connector, commercially standardized as FOCIS 10 in accordance with the Fiber Optic Connector Intermateability Standards, in EIA/TIA-604-10.

Generally, the locking tongue 106 of the connector 100 is a semi-resilient protrusion which is capable of providing a releasable connection to a female connector (not shown), when the connector 100 is in connection therewith. In many embodiments, the locking tongue 106 is capable of maintaining a substantially secure connection between the connector 100 and the female connector. To release the connection, a force may be applied to the locking tongue 106, causing it to pivot or bend, and release the secure connection with the female connector.

Figure 2:
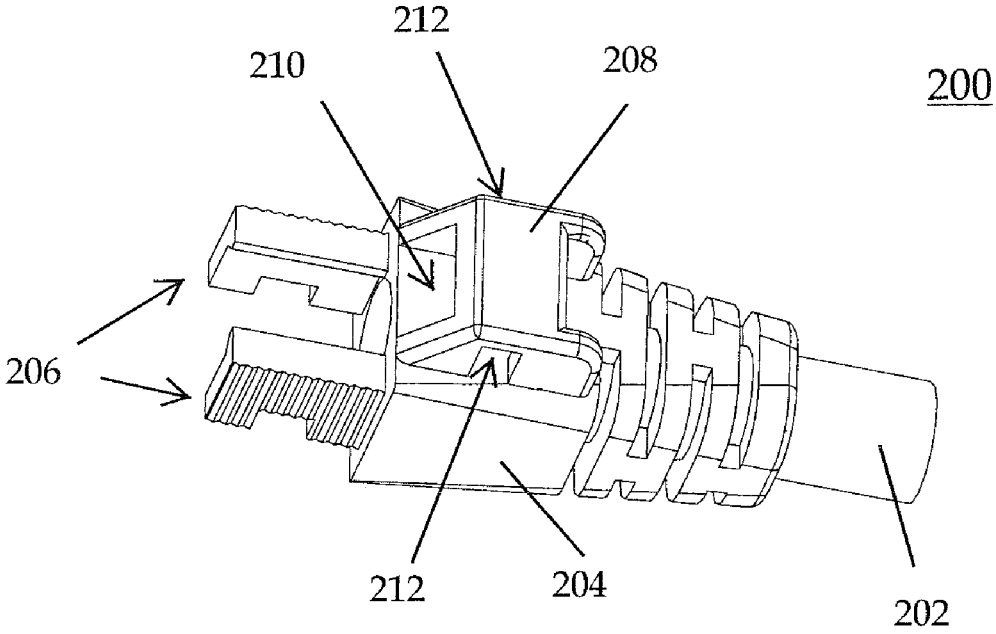
FIG. 2 depicts a perspective view of a cable terminal in accordance with one embodiment of the present invention.

FIG. 2 depicts a perspective view of a cable terminal in accordance with one embodiment of the present invention. In accordance with many embodiments. The cable terminal 200 generally comprises a cable or a portion of the cable 202, a body 204, and at least one conductive terminal 206. The cable 202 may include any type of current-carrying cable suitable for embodiments of the present invention.

In accordance with embodiments of the present invention, the conductive terminal 206 of a cable terminal 200 is designed to be accommodated by one or more types of connectors. For example, as shown in FIG. 2, the cable terminal 200 may engage a typical RJ45 connector, and the conductive terminals 206 will align with the appropriate contacts in the RJ45 connector to transmit data thereto. It should be appreciated however, certain cables may be suitable for a variety of connectors and associated signal transmission. Therefore, in certain embodiments of the present invention, a single cable terminal 200 may be adaptable to any number of connector types.

The body 204 of the cable terminal generally comprises a lock support 208 to protrude from a top surface of the body 204. The lock support 208 is a substantially rigid structure, extending from, yet integral with, the body 204 of the cable terminal 200 for supporting the locking device (not shown). In many embodiments, the lock support 208 generally comprises a support pathway 210 extending along the length of the cable terminal 200. The lock support 208 also generally comprises at least one engagement portion 212 for engaging the locking device in use.

As shown in FIG. 2, the engagement portion 212 may comprise an aperture, or pair of apertures extending through opposing sidewalls of the lock support 208. In alternative embodiments, the engagement portion 212 may comprise a cavity in the sidewall of the lock support 208, capable of receiving and retaining a retaining mechanism of a locking device as discussed below. In yet further embodiments, the engagement portion 212 may comprise any structure suitable for performing the functions of the engagement portion 212 as set forth herein.

Figure 3:
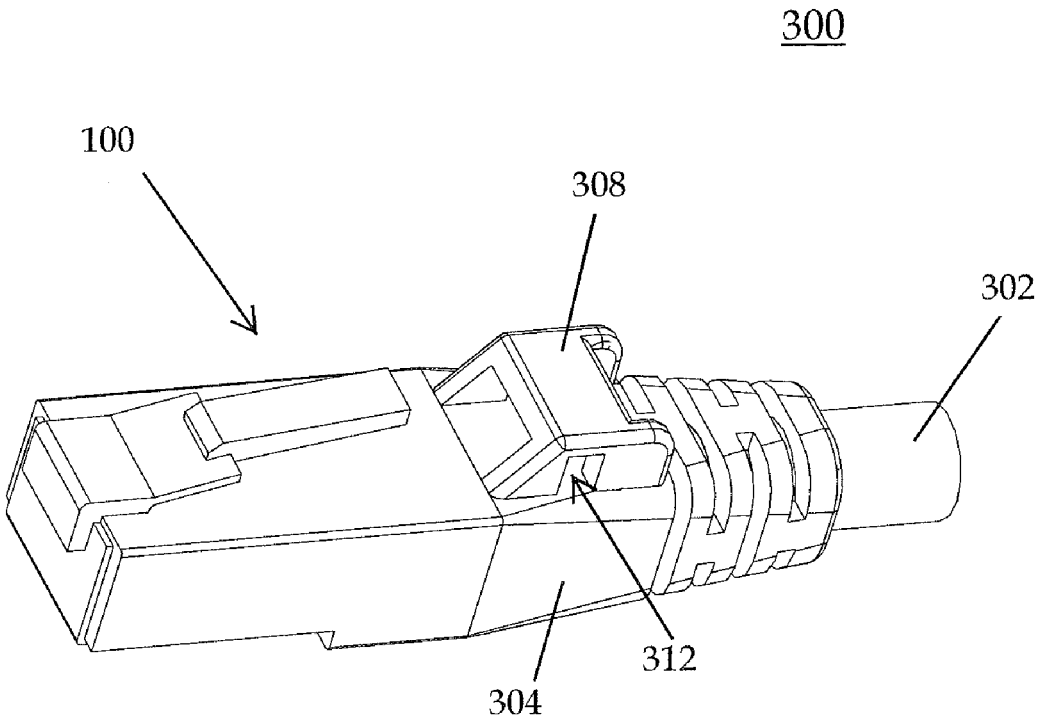
FIG. 3 depicts a perspective view of a cable connector assembly in accordance with one embodiment of the present invention.

Rather than providing separate connectors and cable terminals, certain embodiments of the present invention provide for a cable connector assembly, as depicted in FIG. 3. As shown in FIG. 3, the cable connector assembly 300 comprises a cable 302, or portion thereof, a cable terminal body 304 and a connector 100. In accordance with embodiments of the present invention, the cable connector assembly 300 is also provided with a lock support 308, having at least one engagement portion 312.

Figure 3A:
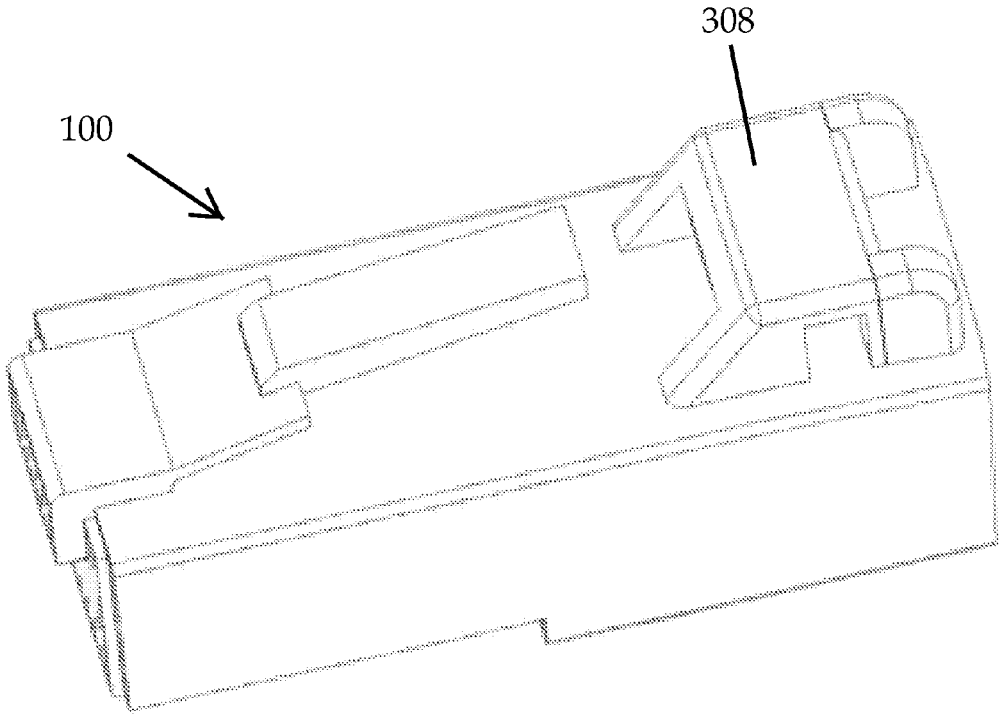
FIG. 3A depicts a perspective view of a connector in accordance with one embodiment of the present invention.

The cable connector assembly 300 may be provided as a single unitary structure, i.e., the connector 100 and the cable terminal body 304 are unintended to be separated by an end user. Similarly, in certain embodiments, the cable terminal body 304 may be incorporated into the connector 100 itself, for example, as depicted in FIG. 3A. In alternative embodiments however, the cable connector assembly 300 may be viewed as a combination of the cable terminal 200 of FIG. 2 and the connector 100 from FIG. 1, as separable components.

Figure 4A:
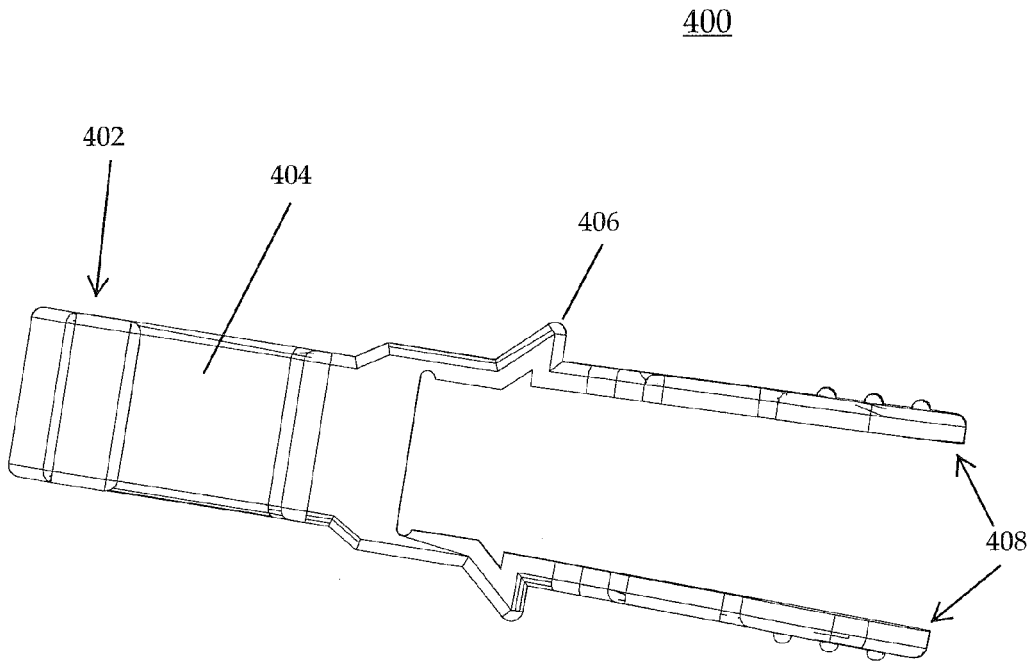
FIG. 4A depicts a top view of a self-releasing connector locking device in accordance with one embodiment of the present invention.
Figure 4B:
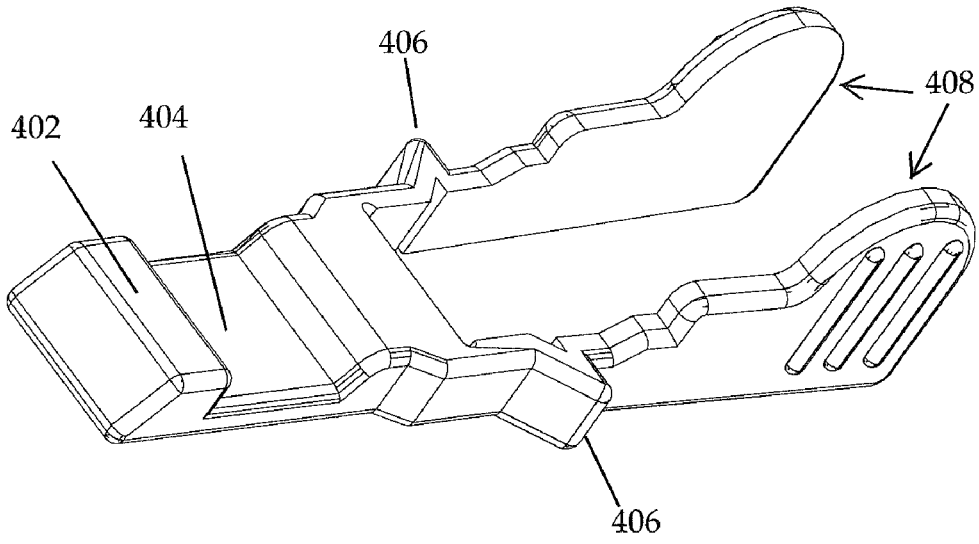
FIG. 4B depicts a perspective view of the self-releasing connector locking device as shown in FIG. 4A.

FIGS. 4A and 4B depict a top view and perspective view, respectively, of a self-releasing connector locking device in accordance with one embodiment of the present invention. In accordance with embodiments of the present invention, the self-releasing connector locking device 400 comprises a locking tongue support 402, at least a first retaining mechanism 406 and at least a first release arm 408. The locking device 400 may also comprise a recessed alignment section 404, for aligning with a lock support of a cable terminal when in use.

The locking device 400 may be manufactured from any material suitable for embodiments of the present invention. In many instances, it may be desirable to manufacture the locking device 400 from non-conductive or poorly conductive materials, to prevent interference with any signal transmission through the cables. For example, in one embodiment the locking device 400 is manufactured from a polymer, such as polyurethane (PU), polyethylene (PE), polypropylene (PP), synthetic rubber, acrylonitrile butadiene styrene (ABS), polycarbonate (PC), fiberglass, combinations thereof, or the like.

In additional to being substantially non-conductive, the locking device 400 may also be made from a material which also provides sufficient resilience to allow the locking device 400 to withstand potential torsion, tension or compressive forces during normal operation. Similarly, to allow the locking device 400 to properly operate, the material selection must be such that the release arm 408 is capable of elastic deformation when a force is applied to the release arm 408 causing it to pivot or bend about its non-free end.

The locking tongue support 402 comprises a protruding portion from the top surface of the locking device 400 for engaging and supporting a locking tongue of a connector. In most embodiments, the height of the locking tongue support 402 is substantially the same as the height of the gap between a connector and its locking tongue. As such, when in position, the locking device 400 prevents the locking tongue from being depressed and released from its secure connection with a female connector. In many embodiments of the present invention, the height of the locking tongue support 402 needs to be sufficient enough to prevent the release of the connector from its female connector, and nominal rotation of the locking tongue may be suitable for this purpose.

The retaining mechanism 406 generally comprises an outward protrusion from the body of the locking device 400. As shown in FIG. 4B there are generally a pair of retaining mechanisms 406, although any suitable number is feasible. In many embodiments, the retaining mechanism 406 comprises an angled protrusion having a low sloped front surface and a substantially steep sloped rear surface, for ease of locking and unlocking. However, rather than a dual surfaced protrusion, embodiments of the present invention also provide the retaining mechanism 406 may comprise any structural limitation for engaging an engagement portion of a lock support of a cable terminal capable of being released by a release arm 408. For example, the retaining mechanism 406 may comprise a bump, a raised pattern or other structural formation on the locking device 400.

The release arm 408 generally comprises a pivotable extension from the locking device 400, capable of releasing the retaining mechanism 406 when engaged with an engagement portion of a lock support. As shown in FIG. 4B, there are generally as many release arms 408 as there are retaining mechanisms 406. In many embodiments, the release arm 408 actually comprises the retaining mechanism 406 thereon. As such, when the release arm 408 is pivoted about its non-free end, the retaining mechanism 406 moves as well, allowing for an opportunity to be released from the engagement portion of a lock support.

In accordance with embodiments of the present invention, the locking device 400 is designed to be self-releasing, i.e., without the need for any additional tools or devices. As such, it is appreciated the release arms 408 of the locking device 400 are capable of releasing the retaining mechanism 406 from an engagement portion of a lock support with a force no greater than what a person of ordinary strength may be able to apply using two fingers, one on each of the release arms 408.

Figure 5A:
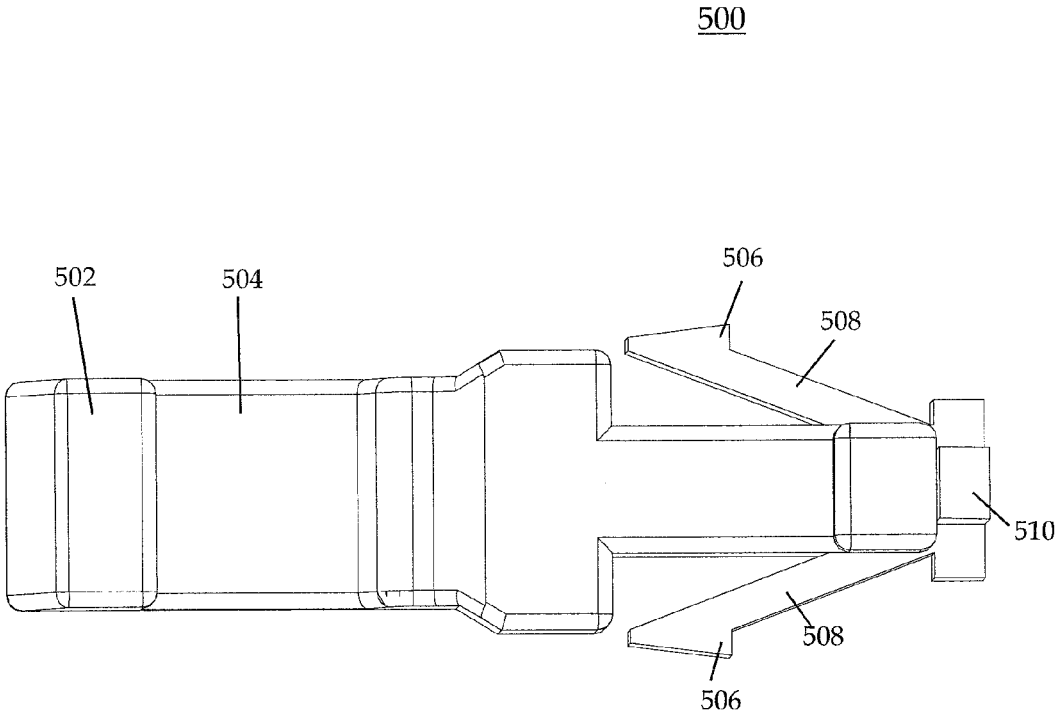
FIG. 5A depicts a top view of a keyed-release connector locking device in accordance with one embodiment of the present invention.
Figure 5B:
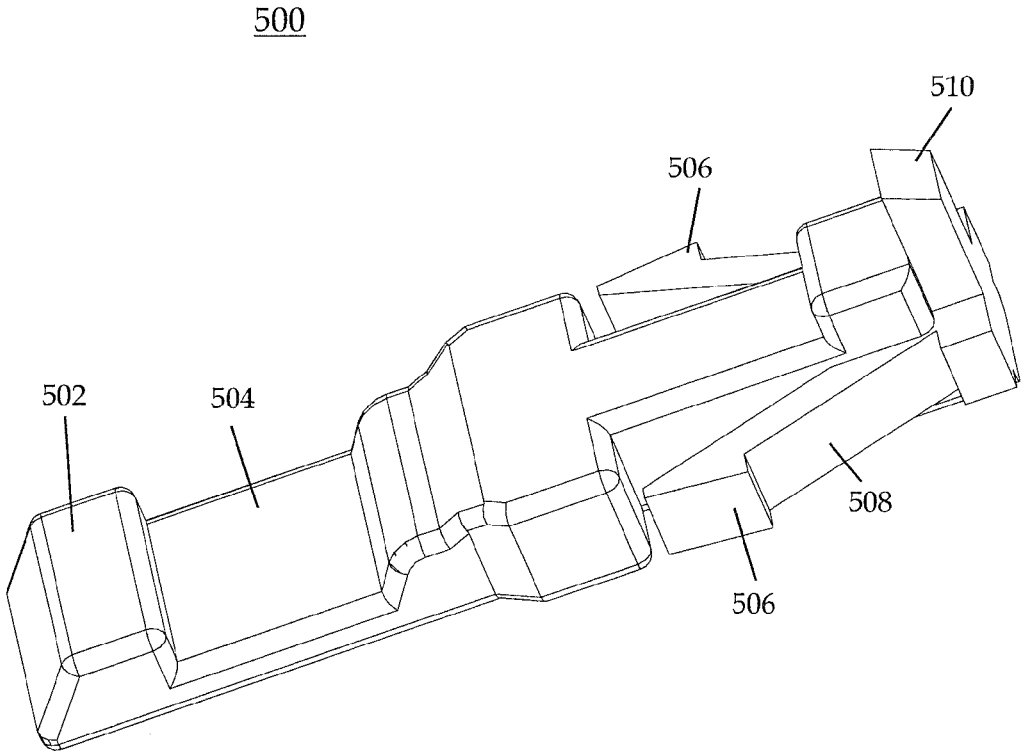
FIG. 5B depicts a perspective view of the keyed-release connector locking device as shown in FIG. 5A.

FIGS. 5A and 5B depict a top view and perspective view, respectively, of a keyed-release connector locking device in accordance with one embodiment of the present invention. Similar to the self-releasing connector locking device 400 of FIGS. 4A and 4B, a keyed-release connector locking device comprises a locking tongue support 502, at least a first retaining mechanism 506 at least a first release arm 508, and optionally a recessed alignment section 504 for aligning with a lock support of a cable terminal when in use. In accordance with some embodiments, the locking device 500 may additionally comprise an installation and removal protrusion 510, which is described in greater detail below.

The locking tongue support 502 is substantially identical to the locking tongue support 402 of the self-releasing connector locking device 400 discussed above. Similarly, the structure and function of the retaining mechanism 506 and release arm 508 are substantially similar to their counterparts discussed above. However, the operation of the release arm 508 is substantially different.

The release arm 508 of the locking device 500 generally comprises a pivotable extension from the locking device 500, capable of releasing the retaining mechanism 506 when engaged with an engagement portion of a lock support. Unlike the release arm 408 of the locking device 400, having its free end being the distal end from the locking tongue support 402, the release arm 508 of the locking device 500 has its free end as the nearest end to the locking tongue support 502. Thus, in order to pivot, a force need be applied to on the release arm 508 near the retaining mechanism 506.

Figure 6:
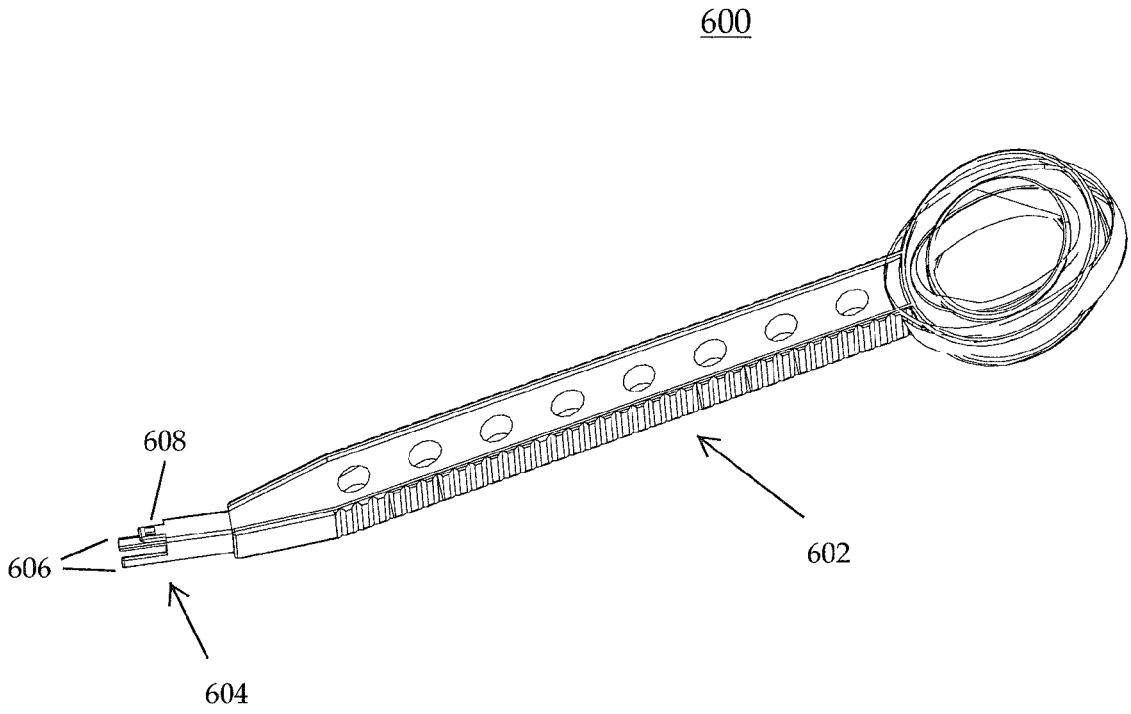
FIG. 6 depicts a perspective view of a key for use with a keyed-release connector locking device in accordance with one embodiment of the present invention.

When in use, the release arm 508 is unreachable by a user's hand, such that an additional tool or device is required. FIG. 6 depicts a perspective view of a key for use with a keyed-release connector locking device in accordance with one embodiment of the present invention. In accordance with embodiments of the present invention, a key 600 generally comprises a handle portion 602 and an engagement portion 604. The handle may be any length, size or shape, provided it is suitable for embodiments of the present invention. The key 600 may be made of any polymer, metal or other substantially rigid material, suitable for embodiments of the present invention.

The engagement portion 604 of the key 600 generally comprises a release prong 606 and a support means 608 for engaging the installation and removal protrusion of a locking device, for example, the keyed-release connector locking device 500. As shown in FIG. 6, the engagement portion 604 may comprise a pair of release prongs 606, however such number is generally dictated by the number of release arms on a keyed-release connector locking device.

Figure 7:
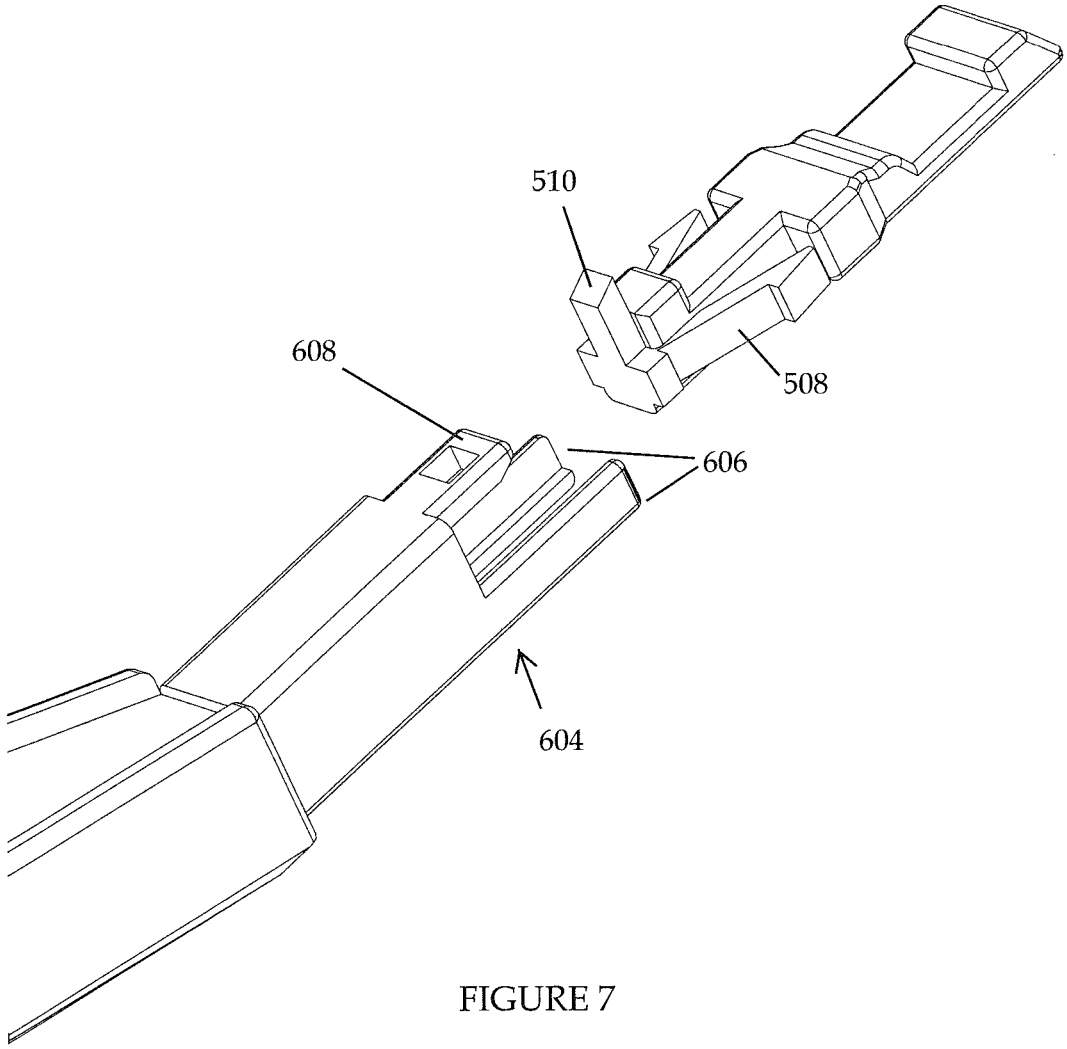
FIG. 7 depicts a perspective view of a key and keyed-release connector locking device in accordance with one embodiment of the present invention.

FIG. 7 depicts a perspective view of a key and keyed-release connector locking device in accordance with one embodiment of the present invention. As shown in the Figure, the engagement portion 604 of a key aligns with a keyed-release connector locking device.

Generally, during use, the support means 608 is engaged with the installation and removal protrusion 510. As shown the support means 608 comprises an aperture through a substantially planar surface having a shape substantially similar to the shape of the installation and removal protrusion 510. It should be appreciated however, the support means 608 and the installation and removal protrusion 510 may be any shape or size feasible for embodiments of the present invention. In addition, in many embodiments, the support means 608 assists in holding and temporarily securing the keyed-release connector locking device during installation or removal of the locking device.

The support means 608 allows for a way to retrieve the keyed-release connector locking device from the lock support, when it is desired be removed or unlocked. Once the support means 608 engages the installation and removal protrusion 510, the engagement portion 604 of the key will be in position to allow the release prongs 606 to engage the release arms 508. As the release arms 508 are engaged by the release prongs 606, the release arms 508 pivot about the non-free end, allowing the retaining mechanisms to be released from the associated engagement portion of a lock support.

Figure 8:
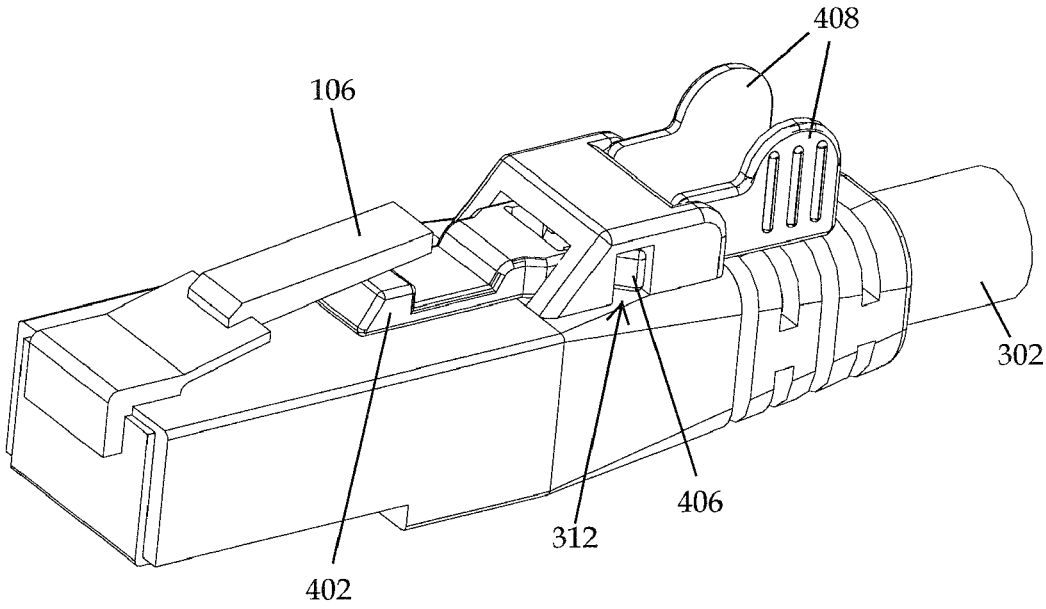
FIG. 8 depicts a perspective view of a connector cable assembly utilizing a self-releasing connector locking device in accordance with one embodiment of the present invention.

FIG. 8 depicts a perspective view of a connector cable assembly utilizing a self-releasing connector locking device in accordance with one embodiment of the present invention. As shown in the Figure, when engaged, the self-releasing connector locking device is secured within the lock support of the cable terminal base. As such, the locking tongue support 402 of the locking device is securely positioned underneath the locking tongue 106, preventing it from being depressed and ensuring a connection with the associated female connector is secure.

To release or unlock the connector cable assemble, a user need only apply a compressive (i.e., pinching or squeezing) force on the release arms 408. As the release arms 408 pivot, the retaining mechanisms 406, which are securely positioned through the engagement portion 312 of the lock support, also pivot. When the release arms 408 reach a release point, the retaining mechanisms 406 will be free from the engagement portions 312, such that the locking device may be removed from the lock support by sliding the locking device away from the connector, without any further structural interference from the engagement portions 312.

In certain embodiments, it may be desirable to have control over outer access to the opening of the engagement portion 212, for example, via a sliding lock (not shown), to prevent undesirable access to the retaining mechanisms. As such, embodiments of the present invention incorporate such basic structural safety and security measures as would be readily available to one of ordinary skill in the art.

Figure 9A:
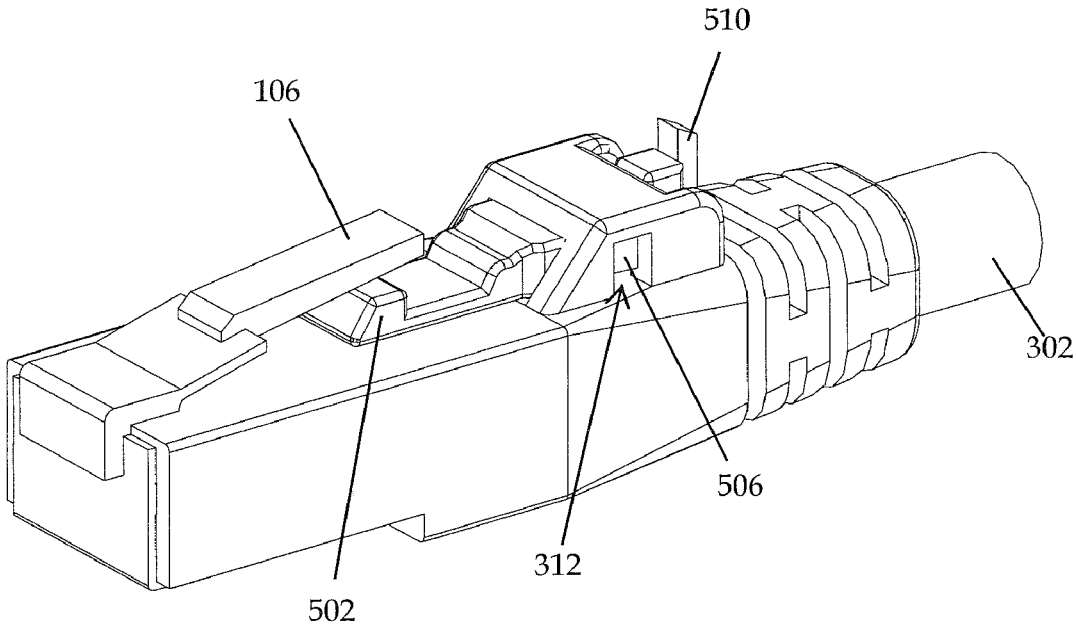
FIG. 9A depicts a perspective view of a connector cable assembly utilizing a keyed-release connector locking device in accordance with one embodiment of the present invention.
Figure 9B:
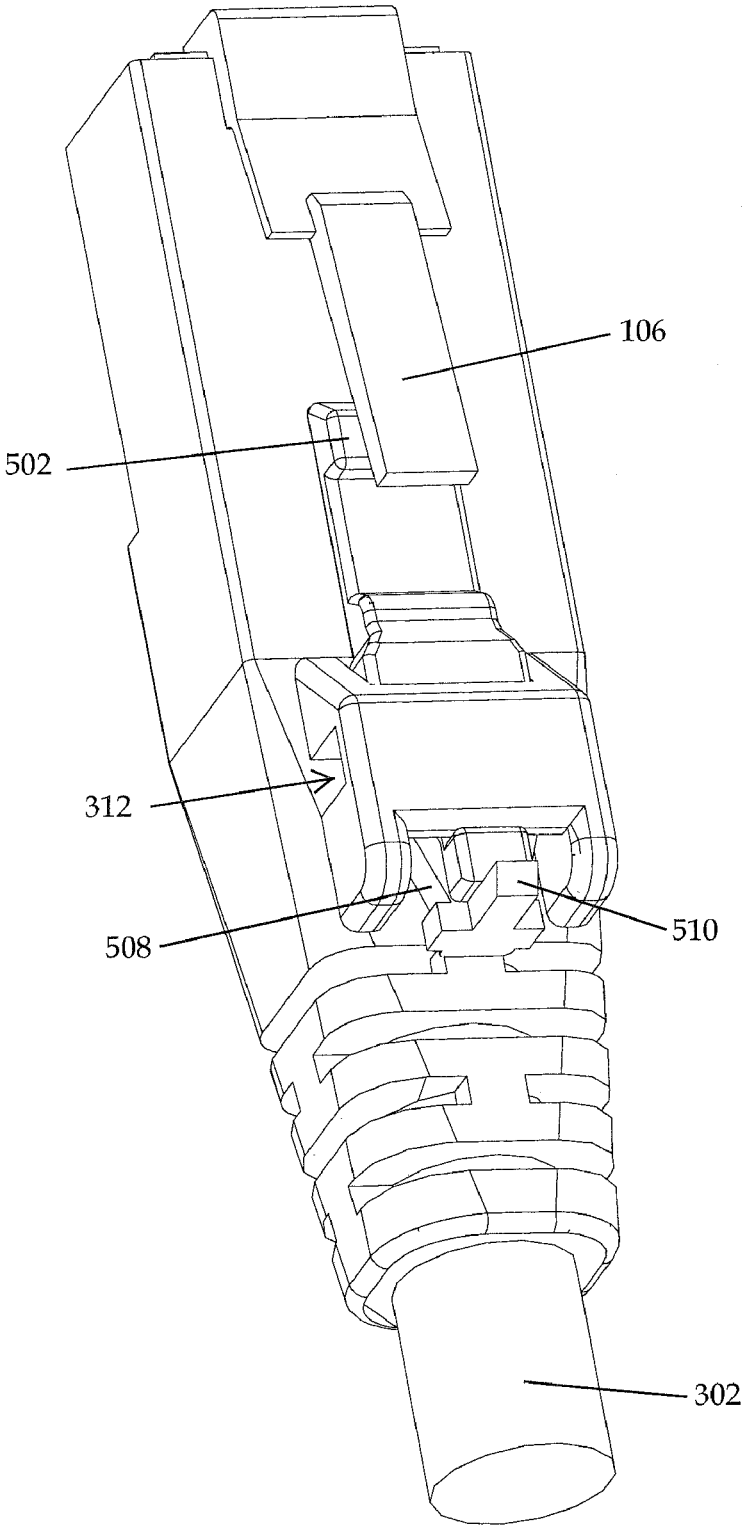
FIG. 9B depicts a top view of the connector cable assembly utilizing a keyed-release connector locking device of FIG. 9A.

FIGS. 9A and 9B depict a perspective view and top view, respectively, of a connector cable assembly utilizing a keyed-release connector locking device in accordance with one embodiment of the present invention. Similar to the self-releasing connector locking device above, when in position, the keyed-release connector locking device prevents the locking tongue 106 being depressed and ensuring a connection with the associated female connector is secure. As shown in the Figures, when the keyed-release connector locking device is engaged, there is no reasonable means to release the locking device without having the appropriate key or tool.

Figure 10:
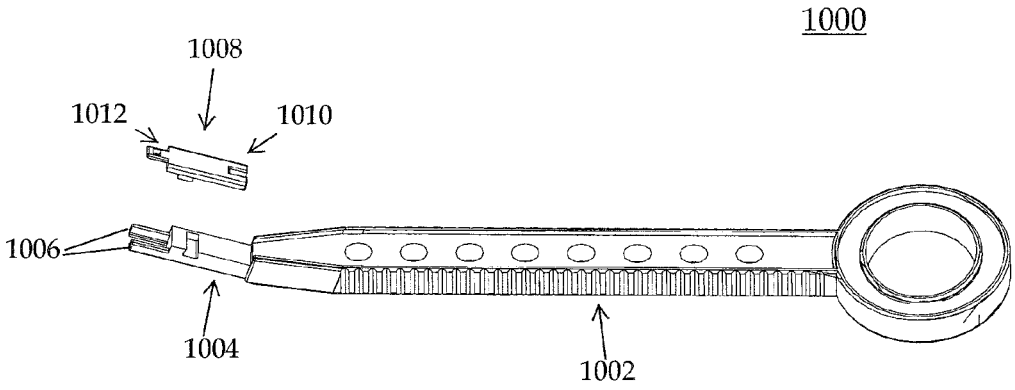
FIG. 10 depicts a perspective view of a key having an interchangeable installation and removal tool in accordance with one embodiment of the present invention.

FIG. 10 depicts a perspective view of a key having an interchangeable installation and removal tool in accordance with one embodiment of the present invention. In accordance with certain embodiments of the present invention, particularly where there are difficult to reach cables or awkward positioning of network cards or similar devices, a modified key 1000 is provided to assist in the installation and removal of the keyed-release locking device disclosed herein.

In one embodiment, the modified key 1000 comprises a handle portion 1002 and an engagement portion 1004. Similar to the key 600, the engagement portion 1004 comprises a release prong 1006. However, the modified key 1000 has an interchangeable support means 1008.

Generally, the interchangeable support means 1008 comprises a removable structure having a common support means 1012 on a first end of the structure, as disclosed above with key 600, and may comprise support prongs 1010 on a second end of the structure for assistance with installation of a locking device in accordance with embodiments of the present invention. In many embodiments, the interchangeable support means 1008 assists in holding and temporarily securing the keyed-release connector locking device during installation or removal of the locking device.

The interchangeable support means 1008 may be connected to the engagement portion 1004 via any suitable removable attachment. For example, as shown in the Figure, the interchangeable support means 1008 may be capable of sliding in and out of a receptive portion of the engagement portion 1004. Alternative structures may also include a form-fitting releasable lock, a snap, a resealable adhesive or the like.

As understood by embodiments of the present invention, the support prongs 1010 may allow a user to have additional support if the keyed-release connector locking device is positioned in a difficult to access location, for example, on a very crowded network card, a vertically positioned connection, or an upside-down positioned connection.

Alternative embodiments of the present invention are also contemplated herein. For example, as technology progresses changes are being made in cabling, particularly in areas like fiber optics. In certain embodiments, a plurality of connectors may be extended from a single cable terminal, but in communication with a plurality of cables into the single cable terminal. In such of embodiments, the locking devices disclosed herein may be modified, for example, by having a plurality of locking tongue supports, one for each of the connectors.

It should be emphasized that the above-described embodiments of the present invention are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

What is claimed is:

1. A keyed-release connector locking device comprising:

a locking tongue support for supporting a locking tongue of a connector, the locking tongue of the connector consisting of a member biased about a front of the connector on a top surface thereof, extending towards a rear of the connector;

a first retaining mechanism for engaging a portion of a body of a terminal, the body of the terminal comprising a structure having a housing on a top surface thereof for receiving the first retaining mechanism;

a key-accessible release arm for releasing the first retaining mechanism from the portion of the body of the terminal when pivotably engaged; and a key having a first release prong for engaging the key-accessible release arm.

2. The keyed-release connector locking device of claim 1, further comprising a second retaining mechanism for engaging a second portion of the body of the terminal, and a second release arm for releasing the second retaining mechanism.

3. The keyed-release connector locking device of claim 1, wherein a width of the self-releasing connector locking device is less than a width of the connector.

4. The keyed-release connector locking device of claim 1, wherein the connector comprises one of a modular connector having an industry-standard Registered Jack designation, or an LC connector.

5. The keyed-release connector locking device of claim 1, wherein the portion of the body of the terminal comprises an inner sidewall of a lock support.

6. The keyed-release connector locking device of claim 1, further comprising an installation and removal protrusion extending from a top surface of the locking device.

7. The keyed-release connector locking device of claim 1, wherein the key further comprises a second release prong for engaging a second release arm.

8. The keyed-release connector locking device of claim 1, wherein the key further comprises a support means for engaging an installation and removal protrusion extending from a top surface of the locking device, and for facilitating the installation and removal of the locking device.

9. The keyed-release connector locking device of claim 8, wherein the support means comprises a removable structure having a common support means on a first end and support prongs on a second end for assistance with installation of the locking device.

10. A locking cable connector assembly comprising:

a cable for transmitting data from a first device to a second device;

a terminal on a first end of the cable having a lock support thereon, the terminal for engaging a connector having a locking tongue; and a locking device comprising:

a locking tongue support for supporting the locking tongue of the connector, the locking tongue of the connector consisting of a member biased about a front of the connector on a top surface thereof, extending towards a rear of the connector;

a first retaining mechanism for engaging the lock support the body of the terminal comprising a structure having a housing on a top surface thereof for receiving the first retaining mechanism;

a key-accessible release arm for releasing the first retaining mechanism from the portion of the body of the terminal when pivotably engaged; and a key having a first release prong for engaging the key-accessible release arm.

11. The locking cable connector assembly of claim 10, wherein a width of the locking device is less than a width of the connector.

12. The locking cable connector assembly of claim 10, wherein the connector comprises one of a modular connector having an industry-standard Registered Jack designation, or an LC connector.

13. The locking cable connector assembly of claim 10, wherein the portion of the body of the terminal comprises an inner sidewall of a lock support.

14. The locking cable connector assembly of claim 10, further comprising an installation and removal protrusion extending from a top surface of the locking device.

15. The locking cable connector assembly of claim 10, wherein the key further comprises a second release prong for engaging a second release arm.

16. The locking cable connector assembly of claim 10, wherein the key further comprises a support means for engaging an installation and removal protrusion extending from a top surface of the locking device, and for facilitating the installation and removal of the locking device.

17. The locking cable connector assembly of claim 16, wherein the support means comprises a removable structure having a common support means on a first end and support prongs on a second end for assistance with installation of the locking device.

* * * * *